US009850657B2

(12) United States Patent
Fink et al.

(10) Patent No.: US 9,850,657 B2
(45) Date of Patent: Dec. 26, 2017

(54) ACOUSTIC PANEL FOR PARTITION WALL ASSEMBLY

(71) Applicant: Steelcase Inc., Grand Rapids, MI (US)

(72) Inventors: Roy W. Fink, Portage, MI (US); Mark T. Slager, Caledonia, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 15/053,512

(22) Filed: Feb. 25, 2016

(65) Prior Publication Data

US 2017/0247880 A1 Aug. 31, 2017

(51) Int. Cl.
*E04B 1/82* (2006.01)
*E04B 2/74* (2006.01)

(52) U.S. Cl.
CPC ..... *E04B 2/7409* (2013.01); *E04B 1/8209* (2013.01)

(58) Field of Classification Search
CPC ..... E04B 2/7409; E04B 1/8209
USPC ..... 52/144, 126.3, 126.4, 204.52, 302.1, 52/171.3
See application file for complete search history.

(56) References Cited

U.S. PATENT DOCUMENTS 2,766,855 A * 10/1956 Johnson ..... E04B 2/76 52/126.3
4,319,661 A 3/1982 Proudfoot
4,538,390 A * 9/1985 Yeager ..... E04B 2/7409 174/495
4,605,088 A * 8/1986 Sickels ..... E04B 1/99 181/290
4,631,881 A * 12/1986 Charman ..... E04B 2/7425 160/135
4,702,046 A * 10/1987 Haugen ..... E04B 1/10 181/286
4,901,485 A * 2/1990 Menchetti ..... E04B 9/0428 181/291
5,317,113 A * 5/1994 Duda ..... E04B 1/84 181/285
5,598,669 A * 2/1997 Hamdi ..... E06B 3/6707 181/284

(Continued)

FOREIGN PATENT DOCUMENTS

AU 2014201988 A1 10/2014
CN 103915090 A 7/2014

(Continued)

*Primary Examiner* — Basil Katcheves
(74) *Attorney, Agent, or Firm* — Price Heneveld LLP

(57) ABSTRACT

An office partition system including a partition frame having front and rear sides. Front and rear transparent sheet material is disposed on the front and rear sides of the partition frame, respectively. Horizontally and vertically extending dividers are disposed between the front and rear transparent sheet material to define a plurality of vertically juxtaposed interior chambers. The front transparent sheet material comprises a plurality of first sheets, each first sheet having horizontally-extending upper and lower edges. The upper and lower edges of adjacent first sheets are vertically spaced apart to define horizontally elongated gaps therebetween. The horizontally elongated gaps are fluidly connected to interior chambers disposed above and below the horizontal dividers to define Helmholtz resonators whereby sound that is incident on the front side of the partition frame is absorbed to the Helmholtz resonance.

9 Claims, 8 Drawing Sheets

(56) References Cited

U.S. PATENT DOCUMENTS

| | | | | |
|---|---|---|---|---|
| 5,942,736 | A | 8/1999 | Cortonesi | |
| 5,992,109 | A * | 11/1999 | Jonker | E04B 2/7448 52/126.4 |
| 6,069,840 | A | 5/2000 | Griffin et al. | |
| 6,244,378 | B1 | 6/2001 | McGrath | |
| 7,743,884 | B2 | 6/2010 | Thomas et al. | |
| 8,251,175 | B1 | 8/2012 | Englert et al. | |
| 8,636,104 | B2 * | 1/2014 | Meyer | E04B 1/8209 181/286 |
| 8,857,563 | B1 | 10/2014 | Chang et al. | |
| 8,869,933 | B1 | 10/2014 | McKnight et al. | |
| 9,051,740 | B1 * | 6/2015 | Kopish | E04B 2/7435 |
| 9,506,247 | B2 * | 11/2016 | Feldpausch | E04B 2/745 |
| 2002/0070075 | A1 | 6/2002 | Lepoutre | |
| 2003/0089057 | A1 * | 5/2003 | Wiechecki | E04B 2/7427 52/238.1 |
| 2008/0053749 | A1 | 3/2008 | Utsunomiya | |
| 2009/0166127 | A1 | 7/2009 | Thomas et al. | |
| 2014/0075871 | A1 * | 3/2014 | Haan | E05B 65/006 52/309.1 |

FOREIGN PATENT DOCUMENTS

| | | | |
|---|---|---|---|
| EP | 1998161 | A1 | 3/2008 |
| JP | 2009139556 | A | 6/2009 |
| WO | 2008141380 | A1 | 11/2008 |
| WO | 2011128858 | A2 | 10/2011 |
| WO | 2014111068 | A2 | 7/2014 |

* cited by examiner

SAA = 0.46
NRC = 0.45

ACOUSTIC PANEL FOR PARTITION WALL ASSEMBLY

BACKGROUND OF THE INVENTION

Various types of office partition systems have been developed. In order to reduce noise levels, known office partitions may include sound-absorbing panels comprising cloth, porous backing material, and other such materials that are configured to absorb sound. Office partitions/walls may include glass or other transparent panels that permit users to see through the partition/wall. However, known glass panels typically reflect a relatively high percentage of the sound incident on the glass partition.

SUMMARY OF THE INVENTION

One aspect of the present disclosure is an acoustic panel assembly having first and second opposite sides. The acoustic panel assembly may be configured for use as an office partition. The acoustic panel assembly includes a generally quadrilateral panel frame having first and second opposite sides. The panel frame includes vertical side frame members and upper and lower horizontal frame members extending between and interconnecting the vertical side frame members. A central opening extends through the panel frame. The acoustic panel assembly also includes first and second sheets of glass or other suitable light-transmitting impermeable solid material disposed on the first and second opposite sides of the panel frame, respectively, and extending over the central opening. An interior chamber is defined by the first and second sheets, the vertical side frame members, and the upper and lower horizontal frame members. The first sheet defines upper and lower edges, wherein the upper edge is spaced apart from a portion of the upper horizontal frame member to define an upper opening. The lower edge is spaced apart from a portion of the lower horizontal frame member to define a lower opening. Porous material may be disposed in the upper and lower openings. The upper and lower openings connect to the interior chamber to form a Helmholtz resonator such that the first side of the acoustic panel assembly has an average noise reduction coefficient of at least about 0.6 for 125 to 500 Hz.

Another aspect of the present disclosure is an office partition system including a partition frame. The partition frame includes at least two upright partition frame members and at least two horizontally-extending partition frame members that are rigidly interconnected to the upright partition frame members. The office partition system also includes upper and lower vertically juxtaposed acoustic panels disposed between the upright partition frame members. Each acoustic panel includes a generally quadrilateral panel frame and first and second sheets of light-transmitting impermeable solid material. The panel frame includes vertical side panel frame members and upper and lower horizontal panel frame members extending between and interconnecting the vertical side panel frame members such that the panel frame defines a central opening through the panel frame. The first and second sheets are disposed on the opposite sides of the panel frame, and extend over the central opening to define an interior chamber between the first and second sheets, the vertical side panel frame members, and the upper and lower horizontal frame members. The first sheet defines upper and lower edges. The lower edge of the first sheet of the upper acoustic panel is vertically spaced from the upper edge of the first sheet of the lower acoustic panel to define an elongated horizontal opening that is fluidly connected to the interior chambers of the upper and lower acoustic panels to form a Helmholtz resonator that provides maximum absorption for frequency corresponding to adult human speech. Maximum absorption is preferably between about 125 and about 500 Hz.

Another aspect of the present disclosure is an office partition system including a partition frame having front and rear sides. Front and rear transparent sheet material is disposed on the front and rear sides of the partition frame, respectively. Horizontally and vertically extending dividers are disposed between the front and rear transparent sheet material to define a plurality of vertically juxtaposed interior chambers. The front transparent sheet material comprises a plurality of first sheets, each first sheet having horizontally-extending upper and lower edges. The upper and lower edges of adjacent first sheets are vertically spaced apart to define horizontally elongated gaps therebetween. The horizontally elongated gaps are fluidly connected to interior chambers disposed above and below the horizontal dividers to define Helmholtz resonators whereby sound that is incident on the front side of the partition frame is absorbed due to the Helmholtz resonance.

These and other features, advantages, and objects of the present invention will be further understood and appreciated by those skilled in the art by reference to the following specification, claims, and appended drawings.

DETAILED DESCRIPTION

Figure 1:
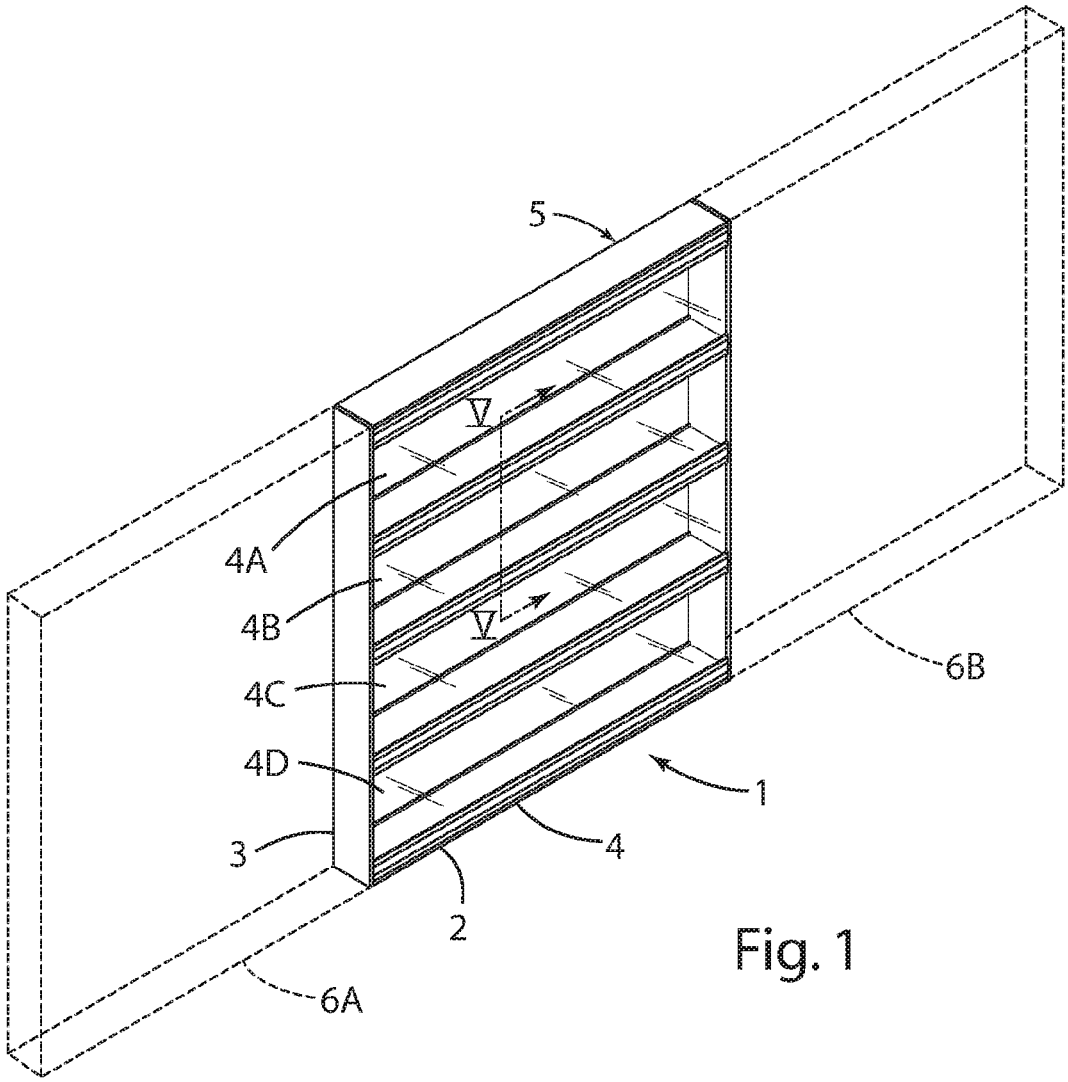
FIG. 1 is an isometric view of a partition according to one aspect of the present disclosure.

For purposes of description herein, the terms "upper," "lower," "right," "left," "rear," "front," "vertical," "horizontal," and derivatives thereof shall relate to the components as oriented in FIG. 1. However, it is to be understood that the components may assume various alternative orientations and step sequences, except where expressly specified to the contrary. It is also to be understood that the specific devices and processes illustrated in the attached drawings, and described in the following specification, are simply exemplary embodiments of the concepts defined in the appended claims. Hence, specific dimensions and other physical characteristics relating to the embodiments disclosed herein are not to be considered as limiting, unless the claims expressly state otherwise.

This patent application is related to U.S. Pat. No. 8,966,842, issued on Mar. 3, 2015, entitled "FLOOR-TO-CEIL- ING PARTITION WALL ASSEMBLY," the entire contents of which are incorporated herein by reference.

With reference to FIG. 1, a partition 1 includes first (front) and second (rear) opposite sides 2 and 3, respectively and a partition frame 5. One or more acoustic glass panels 4 (designated 4A, 4B, 4C, and 4D FIG. 1) may be positioned between adjacent panels 6A and 6B. The adjacent panels 6A and 6B may comprise acoustic glass panels 4 that are substantially identical to the acoustic glass panel 4. Alternatively, panels 6A and 6B may comprise conventional partitions having panels including fabric, wood, or other conventional materials as described in more detail in above-identified U.S. Pat. No. 8,966,842. The acoustic glass panel 4 may comprise a plurality of individual acoustic glass panels 4A-4D that are vertically juxtaposed or stacked on top of one another and supported by a rigid partition frame 5. Acoustic panels 4A-4D may have substantially identical dimensions and construction.

Figure 2:
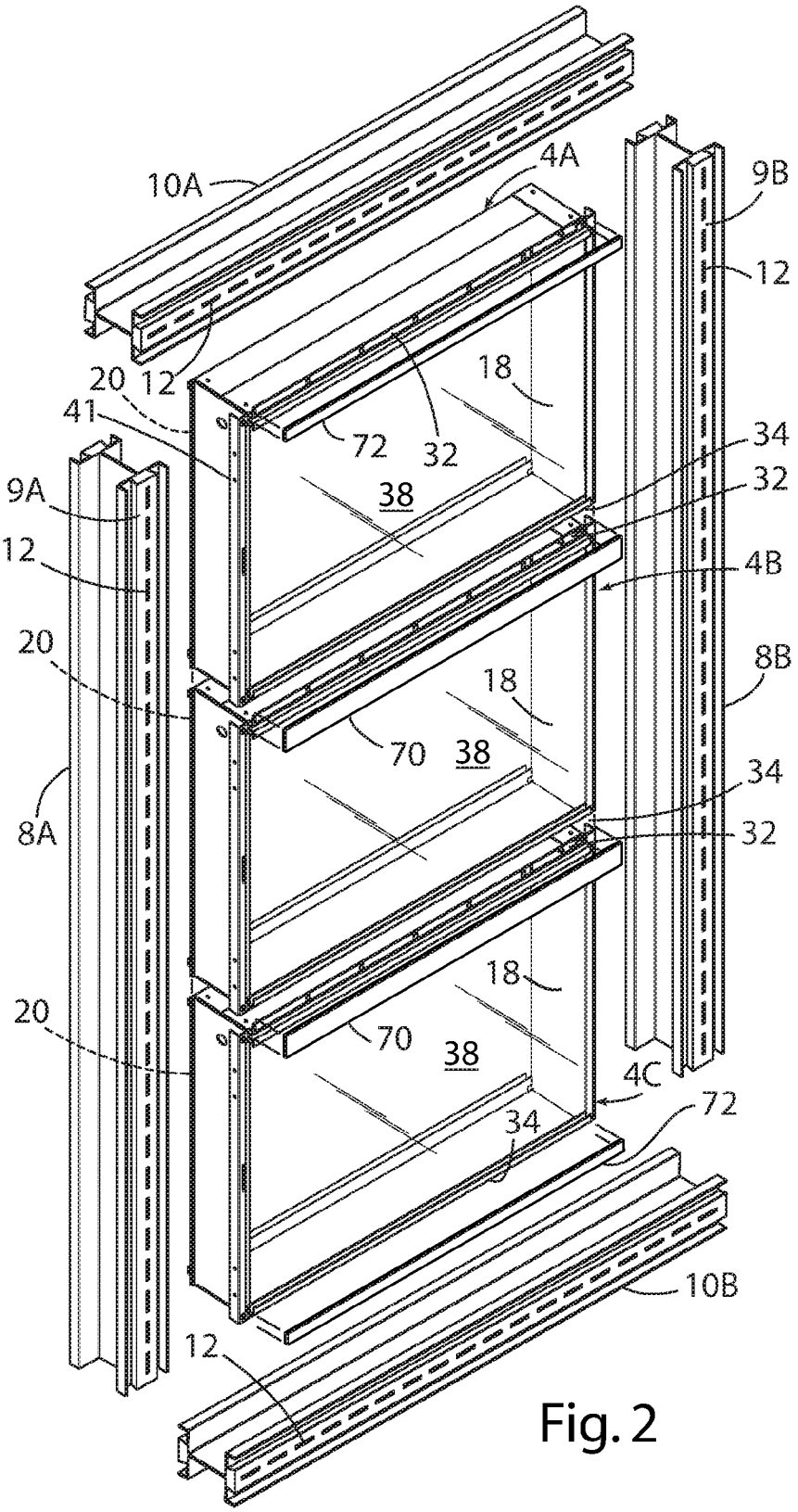
FIG. 2 is an exploded isometric view of a partition having a plurality of acoustic panels.

With reference to FIG. 2, the partition frame 5 may comprise upright frame members 8A and 8B that, when assembled, are rigidly interconnected to horizontal frame members 10B. Upright frame members 8A and 8B may have substantially the same cross sectional shape and configuration as horizontal frame members 10A and 10B. The partition frame members may include rows of slots 12 that are configured to receive hang-on accessory units, hooked brackets or the like. As discussed in more detail below, each panel 4 includes a front sheet 18 and upper openings 32 and lower openings 34 that are connected to interior chambers 38 of each panel 4 to define Helmholtz resonators that absorb noise. Thus, two spaced apart openings (32 and 34) are fluidly connected to a single interior chamber 38. It will be understood that openings 32 and 34 could extend vertically along the vertical side edges of sheet 18 instead of horizontally along the upper and lower edges. Furthermore, openings could extend along both vertical and horizontal edges of sheet 18 to fluidly connect interior chamber 18 to air outside panel 4. When assembled, strips 70 and 72 of fiberglass or other porous material extend over openings 32 and 34. The frame members 8A, 8B, 10A, and 10B may be rigidly interconnected utilizing connectors (not shown) as described in more detail in U.S. Pat. No. 8,966,842. The partition 1 may also include a floor rail and a threaded height adjustment assembly (not shown) as described in U.S. Pat. No. 8,966,842 to thereby adjust the height of the partition 1 and account for uneven floor surfaces. It will be understood that partition frame 5 may comprise other frames, and the present disclosure is not limited to the specific arrangements described herein and in U.S. Pat. No. 8,966,842.

Figure 3:
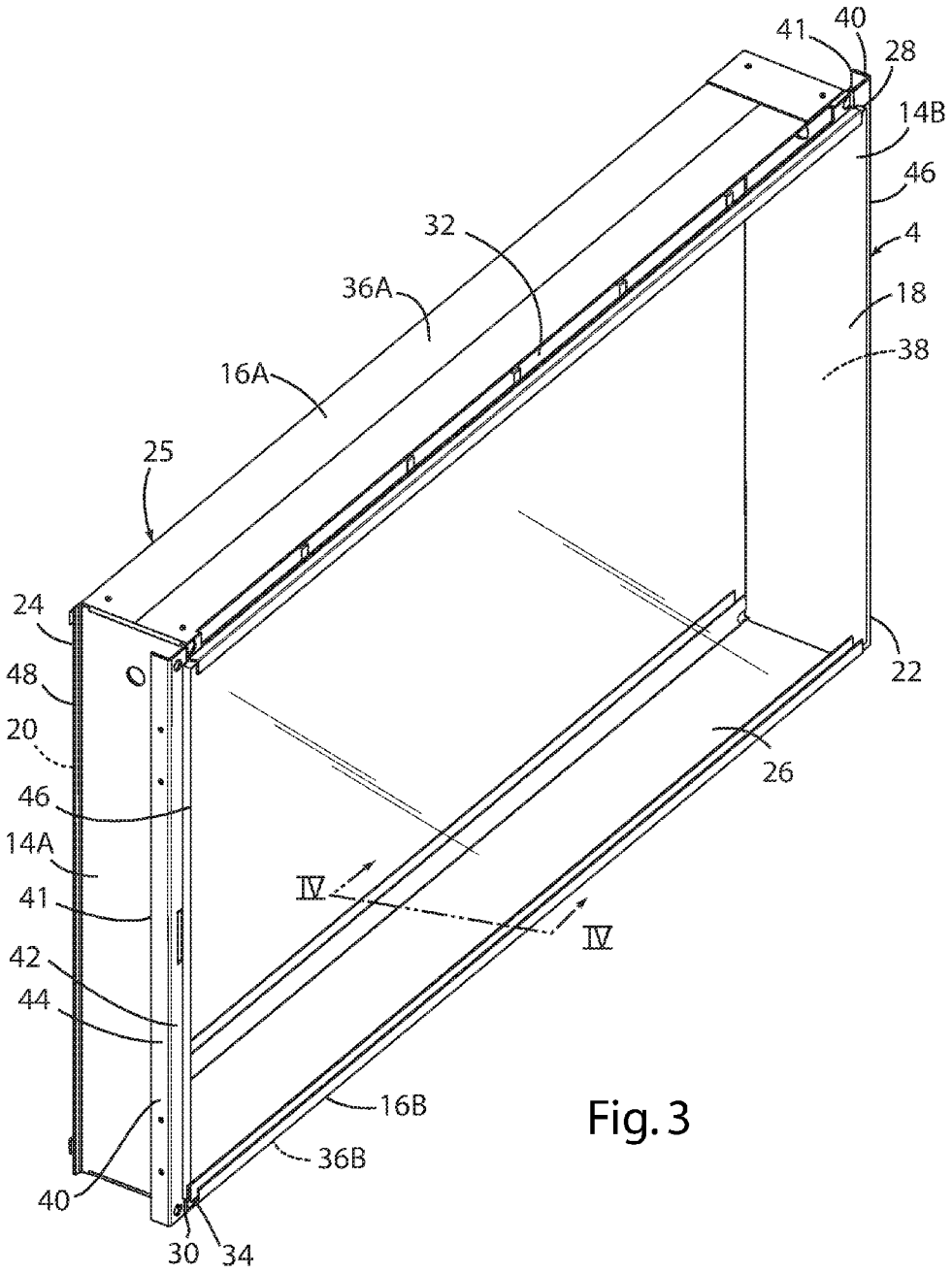
FIG. 3 is an isometric view of an acoustic panel.

With further reference to FIG. 3, an acoustic panel 4 includes vertical side panel frame members 14A and 14B that are rigidly connected to horizontal upper and lower panel frame members 16A and 16B, respectively, utilizing welds, threaded fasteners, or other suitable connecting structures/processes to form a generally rectangular panel frame 25 having an enlarged central opening 26. A front sheet of material 18 is secured to a front side 22 of panel frame 25, and a rear sheet 20 is secured to rear side 24 of panel frame 25 to thereby cover a substantial portion of the opening 26. The front and rear sheets 18 and 20 preferably comprise transparent glass or polymer. However, the front and rear sheets 18 and 20 may comprise tined or translucent glass, polymers, or the like. Sheets 18 and 20 could, alternatively, comprise opaque solid, impermeable materials having low noise absorption characteristics (e.g. wood, metal, etc.). Alternatively, sheets 18 and/or 20 could comprise porous, sound-absorbing material if additional noise absorption is required. Upper edge 28 of front sheet 18 is spaced downwardly from a horizontal web or wall 36 of upper panel frame member 16A to form openings 32, and lower edge 30 of front sheet 18 is spaced upwardly from horizontal wall or web 36B of lower horizontal frame member 16B to form a lower opening 34. The vertical side panel frame members 14A and 14B, horizontal panel frame members 16A and 16B, and front and rear sheets 18 and 20 together define the interior chambers 38. The upper and lower openings 32 and 34 are fluidly connected to the interior chamber 38 and form a Helmholtz resonator that is tuned for maximum absorption (e.g. has a sound absorption coefficient that is generally equal to or above 0.45) in frequencies corresponding to human speech. In a preferred embodiment, the sound absorption coefficient is equal to or above 0.5 in the 125-500 Hz range as discussed in more detail below in connection with FIG. 9. It will be understood that the acoustic panel 4 may be configured to absorb sound in other frequency ranges as required.

The upright side panel frame members 14A and 14B include flanges 40 that are configured to secure the acoustic glass panels 4 to the partition frame 5. The flanges 40 include outwardly-extending first portions 42, and transverse end portions 44. The vertical side edges 46 of first sheet 18 overlap the outwardly extending portions 42 of flanges 40. The peripheral edge portion 48 of rear sheet 20 overlaps the frame members 16A, 16B, 18A, and 18B and thereby substantially closes off the rear side 24 of panel frame 25. Thus, unlike front side 22 of panel 4, rear side 24 of panel 4 does not include openings 32 or 34. Thus, the rear side of panel 4 typically has a significantly higher noise absorption coefficient than front side 24.

Figure 4:
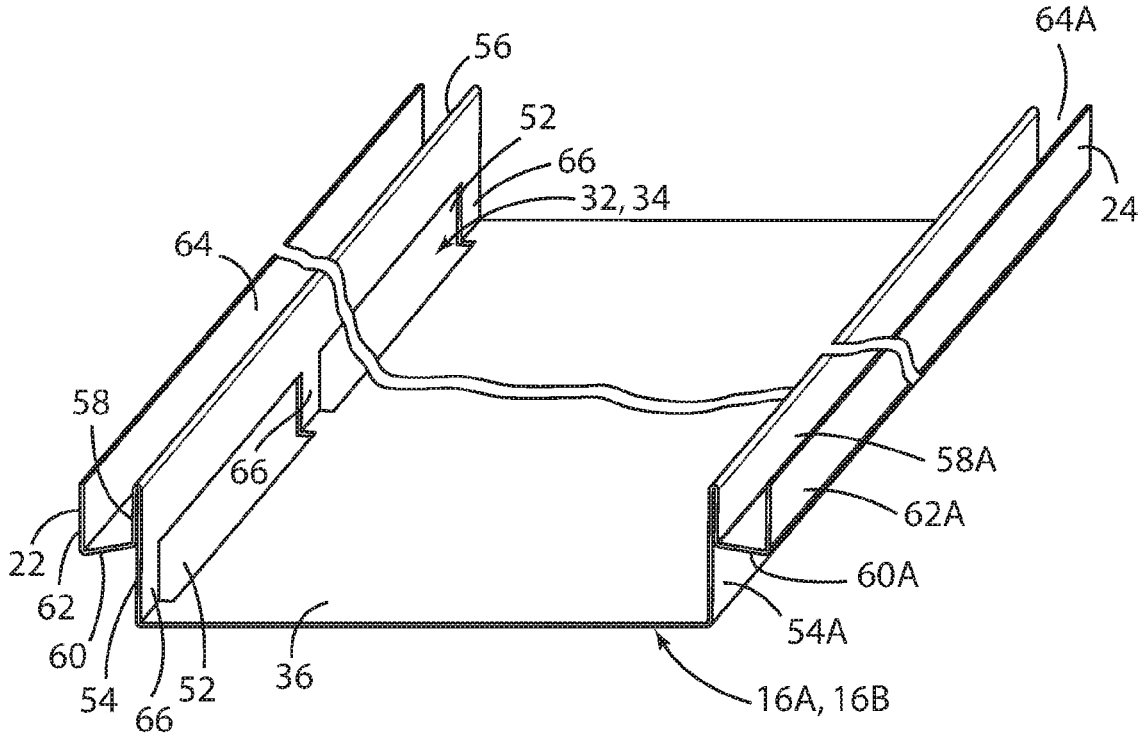
FIG. 4 is a partially fragmentary cross sectional view of a portion of the acoustic panel of FIG. 3.

With further reference to FIG. 4, the upper and lower horizontal panel frame members 16A and 16B have substantially the same construction and cross-sectional configuration. In FIG. 4, the orientation of the front and rear sides 22 and 24 of the horizontal panel frame members 16A and 16B is opposite the orientation of FIG. 3 to more clearly show the rows of individual slots/openings 52 forming upper and lower openings 32 and 34. The horizontal panel frame members 16A and 16B include a horizontal central wall or web 36. Front side 22 includes an upwardly extending flange 54 that is folded downwardly along fold line 56 to form a downwardly extending flange portion 58. Outwardly and upwardly extending flange portions 60 and 62, respectively, together with downwardly extending portion 58 define a channel 64 that receives an upper or lower edge 28 or 30 of front sheet 18 (FIG. 3). A plurality of elongated slots or openings 52 are formed in the flange 54 and a portion of horizontal wall 36. A plurality of reinforcements 66 extend between horizontal wall 36 and flange 54. A plurality of individual openings 52 thereby form the horizontally elongated upper and lower openings 32 and 34, respectively. Rear side 22 of frame members 16 include flanges 54A, 58A, 60A, and 62A forming channel 64A that receives an upper or lower edge of rear sheet 20 when assembled. In contrast, to flange 54, flange 54A does not include openings 52, such that interior chamber 38 does not open to second or rear side 24 of panel 14.

Figure 5:
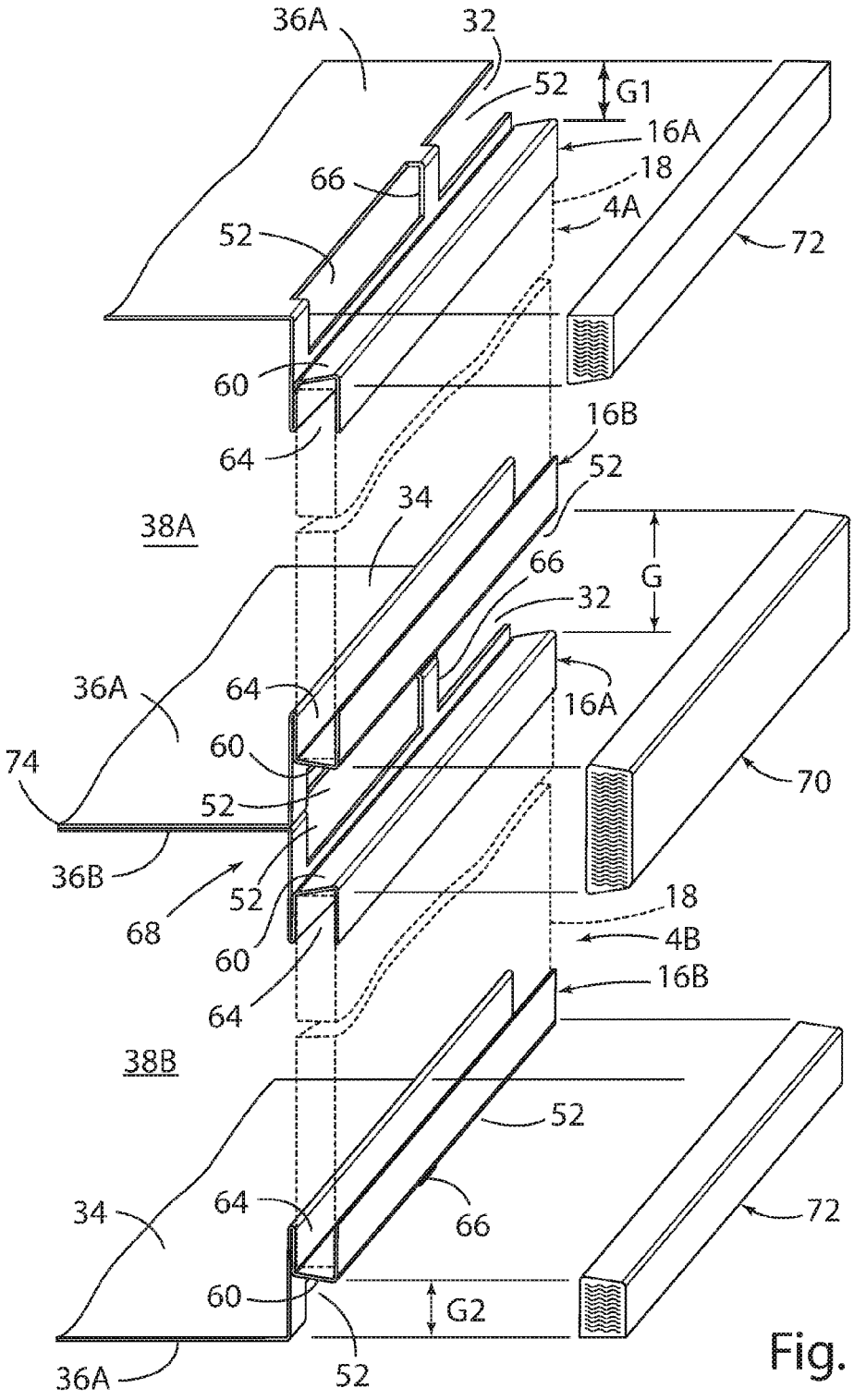
FIG. 5 is a cross sectional view of a portion of the partition of FIG. 1.

With further reference to FIG. 5, when assembled the vertically adjacent acoustic glass panels 4A-4B etc. are stacked on top of each other with horizontal walls 36A of lower frame members 16B disposed on walls 36B of upper frame members 16A. Vertically adjacent acoustic panels 4 may be interconnected utilizing threaded fasteners or other suitable connectors. Alternatively, adjacent acoustic panels 4 may be retained in an assembled/stacked configuration by gravity. When assembled, rear edges 41 (FIG. 3) of flanges 40 abut front faces 9A and 9B (FIG. 2) of upright partition frame members 8A and 8B, respectively. The panel frames 25 may be secured to the partition frame members 8A, 8B, 10A, and 10B utilizing threaded fasteners (not shown) or other suitable connectors.

Referring again to FIG. 5, the adjacent upper and lower openings 32 and 34 formed by the individual openings 52 are fluidly connected to a gap or opening 68 having a dimension "G" formed between the flanges 60 of adjacent panels 4. A strip 70 is disposed in the opening 68. Strip 70 comprises fiberglass or other suitable porous material that increases the flow resistance of air passing through the openings into chambers 38 to thereby absorb sound. Strips 72 of porous material may be disposed in an uppermost opening 32 along an upper edge of upper acoustic glass panel 4A, and a strip 72 may be disposed in a lowermost opening 34 of the lowermost acoustic glass panel 4C. The strips 72 have substantially the same construction (e.g. same material) as strip 70, but have a reduced height to fit into smaller gaps G1 and G2 formed by openings 32 and 34 along the upper and lower edges of acoustic glass panels 4A and 4B. Strips 70 and 72 allow sound to pass through openings 32 and 34. However, the porous strips 70 and 72 dissipate the energy of the sound waves as the air passes through openings 32 and 34, thereby increasing the noise reduction coefficient. Testing of panels 4 constructed as described herein showed that a significantly larger noise reduction coefficient (e.g. 0.6 to 0.65 average for 125-500 Hz frequencies) is obtained if porous strips of material 70 and 72 are disposed across openings 32 and 34, relative to the noise reduction coefficient (e.g. approximately 0.2 average for 125-500 Hz frequencies) if strips 70 and 72 are not present. In FIG. 5, the lowermost acoustic glass panel is designated "4B." However, it will be understood that the number of acoustic glass panels 4 will vary as required to provide the desired height for a particular application.

Figure 9:
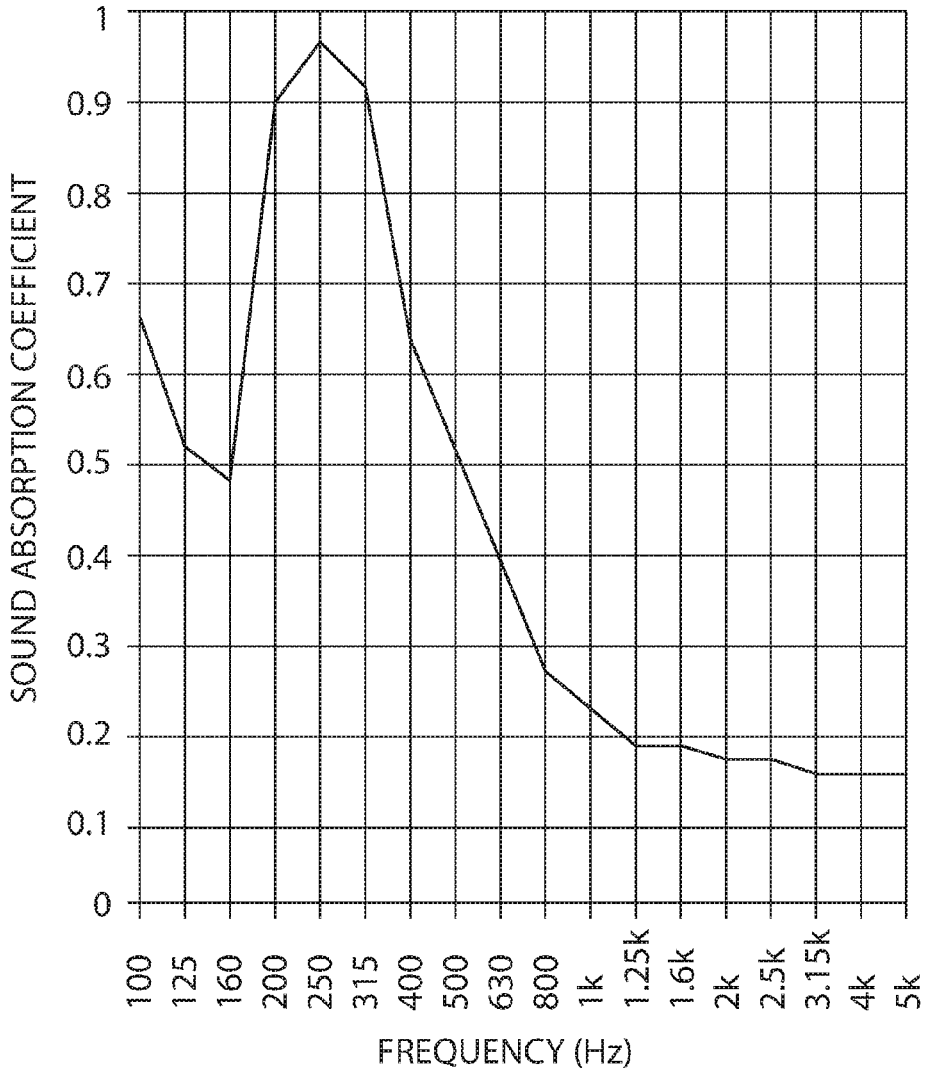
FIG. 9 is a graph showing sound absorption coefficient versus frequency.

The volume of the interior chambers 38A and 38B and the size of the openings 32 and 34 are selected to form a Helmholtz resonator. The volume of the interior chambers 38 and the openings 32 and 34 may be selected to provide an increased sound absorption coefficient in a particular frequency range as required for a particular application. In one embodiment, the chambers 38 have a volume of about 1,500-3,000 cubic inches, and the upper and lower openings 51 have a total combined cross sectional area of about 40-50 square inches. Also, the upper and lower edges 28 and 30 (FIG. 3) of sheets 18 and 20 may be about 30-60 inches, and the sheets 18 and 20 may be about 12-36 inches high. the 125-500 Hz frequency range as shown in FIG. 9. A relatively high percentage of human speech is in the 125-500 Hz range, and the acoustic glass panels 4 are therefore preferably configured to absorb a high percentage of the sound in the 125-500 Hz range for use in offices or other similar environments in which noise in the 125-500 Hz range is produced. In this way, the acoustic glass panels 4 of partition 1 significantly reduce the noise in office settings and the like.

Acoustic panel 4 is configured to provide an average noise reduction coefficient ("NRC") of about 0.45 for 125-500 Hz as shown in FIG. 9. 0.45 is the average absorption coefficient @250, 500, 1000, & 2000 Hz. The NRC that has been calculated as the average of 125, 160, 200, 250, 315, 400, and 500 Mz. It will be understood that the specific sound absorption characteristics of a particular acoustic glass panel 4 may be adjusted by varying the volume of interior chamber 38 and/or openings 32 and/or 34, and/or by adjusting the composition and/or configuration of the filler strips 70 and 72.

Various approaches can be utilized to estimate the Helmholtz frequency of the acoustic panels of the present disclosure. For example, a general equation for frequency determination that may be utilized to optimize the Helmholtz cavity is:

$$f=2160*\sqrt{r/((d*1.2*0*(r+w))}$$

where:

According to one example, if r=0.75 inches, o=3.649 inches, w=16.48 inches, and d=0.292 inches $$f = 2160\times(.75/((.292*1.2*3.649)*(.75*16.48))^{.5}$$
$$= 449\text{ Hz}$$

This may be adjusted for insulation, if insulation (e.g. strips 70) is present $$f = 449*\frac{1}{\sqrt{2}}$$
$$= 318\text{ Hz}$$

It will be understood that equation 1.0 provides an estimated Helmholtz frequency that may be useful in providing acoustic panels. However, the present invention is not limited to panels having a Helmholtz frequency that can be estimated utilizing the given equation. Various design methods and/or testing may be utilized to provide an acoustic panel having the sound absorption characteristics that may be required for a particular application. Also, the dimensions utilized in the example above merely show one possible design, and the present invention is not limited to this example. Nevertheless, it is noted that the estimated Helmholtz frequency (318 Hz) of the example is within the frequency range of 125-500 Hz for human speech, which may be utilized as a design criteria to provide acoustic panels that are suitable for use in office environments or the like. In general, an acoustic panel may be configured to have a Helmholtz frequency near the midpoint of the frequency range of interest (e.g. 312.5 Hz if the frequency range is 125-500 Hz) to provide the required acoustic characteristics (e.g. NRC) for the frequency range of interest.

Figure 6:
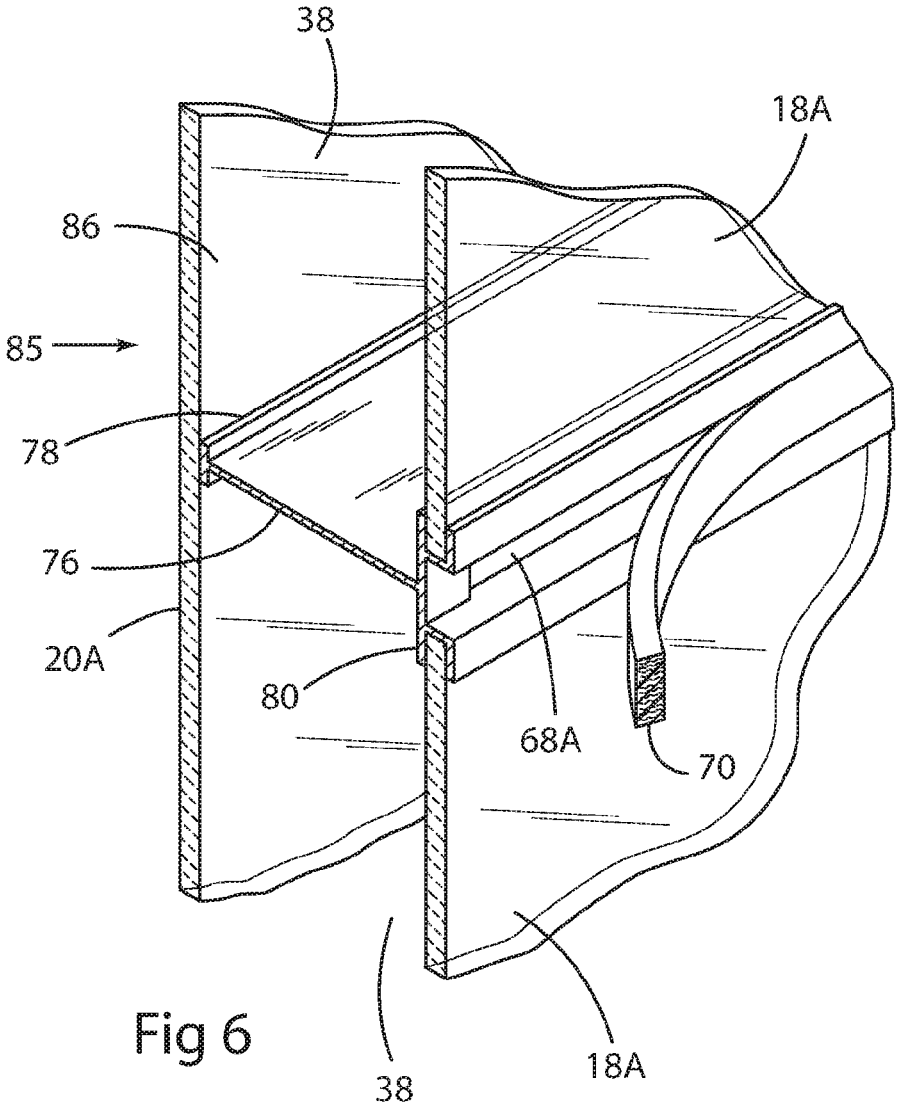
FIG. 6 is fragmentary isometric view of a portion of a partition according to another aspect of the present disclosure.
Figure 7:
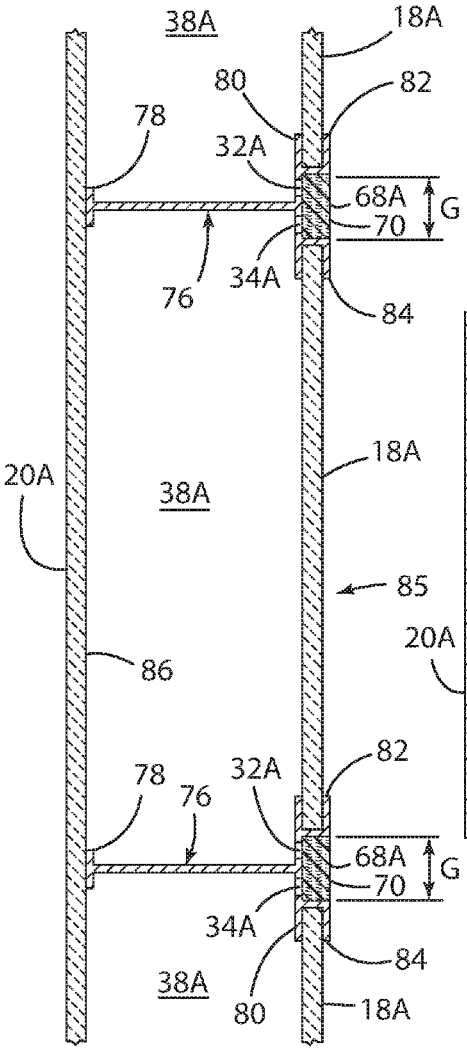
FIG. 7 is a fragmentary cross sectional view of the partition of FIG. 6.
Figure 8:
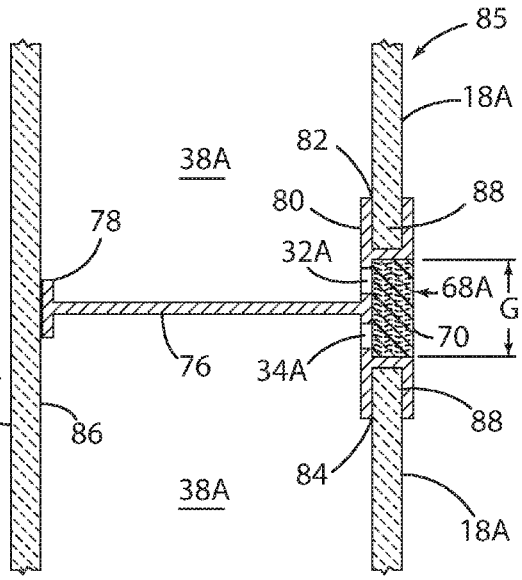
FIG. 8 is a fragmentary, enlarged cross sectional view of the partition of FIG. 7.

With further reference to FIGS. 6-8, an acoustic panel 85 according to another aspect of the present disclosure includes a plurality of vertically juxtaposed first or front sheets of glass 18A, and a single second or rear sheet of glass 20A. A plurality of dividers or partitions 76 extend between and interconnect the sheets 18A and 20A to define interior chambers 38A. The dividers 76 include a rear portion 78 that is attached or sealed to inner surface 86 of sheet 20A. Dividers 76 also include a front portion 80 having upwardly and downwardly opening channels 82 and 84, respectively, that receive horizontal edge portions 88 of front sheets 18A. The front portion 80 of divider 76 includes a front channel or opening 68A between the adjacent sheets 18A. A strip 70 of porous material such as fiberglass is disposed in the opening or channel 68A. The opening or channel 68A is fluidly connected to openings 32A and 34A such that the interior chambers 38A are fluidly connected to the space exterior of the panel 85 to form Helmholtz resonators in substantially the same manner as described above in connection with the acoustic panels of FIGS. 1-5.

The upper acoustic glass panel 4A includes an interior chamber 38A, and the glass panel 4B has an interior chamber 38B. The interior chambers 38A and 38B are fluidly connected through openings 32 and 34 and a single gap or opening 68 disposed adjacent intersection or joint 74 between acoustic panels 4A and 4B.

It is to be understood that variations and modifications can be made on the aforementioned structure without departing from the concepts disclosed herein, and further it is to be understood that such concepts are intended to be covered by the following claims unless these claims by their language expressly state otherwise. For example, openings 32 and 34 could extend along the vertical side edges of sheet 18 rather than the upper and lower edges of sheet 18. Alternatively openings to interior chamber 38 could be provided along substantially the entire perimeter of sheet 18, or only along selected portions thereof.

What is claimed is:

1. An office partition system comprising:

a partition frame including at least two upright partition frame members and at least two horizontally-extending partition frame members that are rigidly interconnected to the upright partition frame members;

upper and lower vertically juxtaposed acoustic panels disposed between the upright partition frame members, each acoustic panel comprising:

a generally quadrilateral panel frame comprising vertical side panel frame members and upper and lower horizontal panel frame members extending between and interconnecting the vertical side panel frame members such that the panel frame defines a central opening through the panel frame;

first and second sheets of light-transmitting impermeable solid material disposed on first and second opposite sides of the panel frame and extending over the central opening to define an interior chamber between the first and second sheets, the vertical side panel frame members, and the upper and lower horizontal panel frame members;

the first sheet defining upper and lower edges;

wherein the lower edge of the first sheet of the upper acoustic panel is vertically spaced from the upper edge of the first sheet of the lower acoustic panel to define an elongated horizontal opening on the first side that is fluidly connected to the interior chambers of the upper and lower acoustic panels and wherein the second side does not include openings that are fluidly connected to the interior chambers such that the elongated horizontal opening on the first side and the interior chambers form a Helmholtz resonator that provides maximum absorption for frequency between 125 and 500 Hz.

2. The office partition system of claim 1, wherein:

the partition system has an average noise reduction coefficient of at least about 0.6 for frequencies of about 125 Hz to about 500 Hz.

3. The office partition of claim 1, including:

porous material disposed in the elongated horizontal opening.

4. The office partition of claim 3, wherein:

the upper and lower edges of the first sheets are spaced apart from the upper and lower horizontal panel frame members, respectively, to define upper and lower panel openings that are fluidly connected to the interior chambers of the acoustic panels.

5. The office partition of claim 4, wherein:

the lower panel opening of the upper acoustic panel and the upper panel opening of the lower acoustic panel are fluidly connected to the elongated horizontal opening.

6. The office partition of claim 1, wherein:

the vertical side panel frame members include connecting structures that connect the acoustic panels to the upright partition frame members.

7. The office partition of claim 1, including:

at least one height adjustment assembly disposed at a lower portion of the partition frame, wherein the height adjustment assembly is configured to adjust a vertical position of the partition frame on a floor surface.

8. The office partition of claim 1, wherein:

the first and second sheets are transparent.

9. The office partition of claim 8, wherein:

the first and second sheets comprise glass.

* * * * *